US011008145B2

(12) United States Patent
Beck et al.

(10) Patent No.: US 11,008,145 B2
(45) Date of Patent: May 18, 2021

(54) PACKING SYSTEM AND METHOD OF PACKING

(71) Applicant: The Procter & Gamble Company, Cincinnati, OH (US)

(72) Inventors: Wolfram Beck, Singapore (SG); Kumaresh Govindan Radhakrishnan, Singapore (SG); Richard Lee Lane, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 276 days.

(21) Appl. No.: 15/954,637

(22) Filed: Apr. 17, 2018

(65) Prior Publication Data

US 2018/0312315 A1 Nov. 1, 2018

Related U.S. Application Data

(60) Provisional application No. 62/491,265, filed on Apr. 28, 2017.

(51) Int. Cl.
*B65D 75/36* (2006.01)
*B65D 77/04* (2006.01)
(Continued)

(52) U.S. Cl.
CPC ..... *B65D 75/366* (2013.01); *B65B 35/56* (2013.01); *B65D 21/0202* (2013.01);
(Continued)

(58) Field of Classification Search
CPC ..... B65D 75/366; B65D 21/0202; B65D 73/0057; B65D 75/522; B65D 77/0413; B65D 2577/047
(Continued)

(56) References Cited

U.S. PATENT DOCUMENTS 3,695,479 A 10/1972 Crabtree
4,423,811 A 1/1984 Knapp
(Continued)

FOREIGN PATENT DOCUMENTS

CA 2597839 2/2008
CA 2870371 11/2013
(Continued)

OTHER PUBLICATIONS

Case AA1222 PCT Search Report; PCT/US2018/028990; 16 Pages; dated Jun. 26, 2018.
(Continued)

*Primary Examiner* — J. Gregory Pickett
*Assistant Examiner* — Niki M Eloshway
(74) *Attorney, Agent, or Firm* — Abbey A. Lopez

(57) ABSTRACT

A packing system for a plurality of articles comprising:
first and second packages;
wherein each of the first and second packages comprises:
a housing comprising a front wall and a rear wall, wherein the rear wall comprises a recessed portion;
an article disposed within the housing, at least a part of the article protruding from the front wall of the housing;
wherein the rear wall comprises a recessed portion, a shape of the recessed portion corresponding to a profile of the at least a part of the article protruding from the front wall,
wherein the front wall of the second package is adjacent to the rear wall of the first package.

5 Claims, 6 Drawing Sheets

(51) Int. Cl.
*B65D 75/52* (2006.01)
*B65D 73/00* (2006.01)
*B65D 21/02* (2006.01)
*B65B 35/56* (2006.01)

(52) U.S. Cl.
CPC ..... *B65D 73/0057* (2013.01); *B65D 75/522* (2013.01); *B65D 77/0413* (2013.01); *B65D 2577/047* (2013.01)

(58) Field of Classification Search
USPC ..... 220/23.83; 206/504, 509, 507
See application file for complete search history.

(56) References Cited

U.S. PATENT DOCUMENTS 4,453,629 A * 6/1984 Goldberg ..... B65D 75/322 206/445
4,582,194 A 4/1986 Karpiloff
4,742,912 A * 5/1988 Lee ..... B65D 11/00 206/459.5
D306,561 S 3/1990 Lee
5,129,516 A 7/1992 Theros
5,499,561 A 3/1996 Quinn
5,564,569 A * 10/1996 Kiefer ..... B65D 75/36 206/461
5,573,117 A * 11/1996 Adams ..... B65D 77/0413 206/449
D400,096 S 10/1998 Lee
D400,098 S 10/1998 Wang
D400,790 S 11/1998 Appelbaum
5,927,496 A * 7/1999 Seaton ..... B65D 21/0235 206/461
D415,417 S 10/1999 Suzuki
6,065,589 A 5/2000 Ouwens
6,170,663 B1 1/2001 Glassman
6,311,845 B1 11/2001 Uren et al.
6,386,368 B1 5/2002 Pirro
D466,405 S 12/2002 Lee
D466,803 S 12/2002 Yang
D471,442 S 3/2003 Lee
6,814,238 B2 * 11/2004 Lee ..... B65D 75/322 206/471
D517,907 S 3/2006 Lee
D521,860 S 5/2006 Lee
D521,861 S 5/2006 Lee
7,097,035 B2 * 8/2006 Agakanian ..... B65D 21/0204 206/467
7,293,651 B2 11/2007 Lee
D678,759 S 3/2013 Gottschalk
D682,084 S 5/2013 Pierre
D702,133 S 4/2014 Partrat
D714,135 S 9/2014 Chang
9,248,210 B2 * 2/2016 Kunesh ..... A61L 9/12
D910,433 S 2/2021 Beck et al.
2001/0032518 A1 10/2001 Boger et al.
2003/0173360 A1 * 9/2003 Rack ..... B65D 21/0202 220/23.4
2005/0014438 A1 1/2005 Oda et al.
2005/0098467 A1 5/2005 Agakanian
2010/0090887 A1 4/2010 Cooper et al.
2010/0230312 A1 9/2010 Sorrentino et al.
2015/0210455 A1 7/2015 Tillstrom
2016/0325900 A1 11/2016 Stone et al.

FOREIGN PATENT DOCUMENTS

CH 680280 A5 7/1992
CH 688280 7/1997
CN 201784956 4/2011
CN 203753664 8/2014
DE 9014877 2/1992
DE 202010012048 1/2012
DE 402008003118-001 9/2013
EP 2412638 10/2013
FR 2800045 4/2001
GB 8529283 1/1986
GB 2169585 A 7/1986
JP S4972639 U 6/1974
JP S5142752 U 3/1976
JP 2002085218 A 3/2002
JP 2005186964 A 7/2005
JP 2006248595 A 9/2006
JP 2009001341 A 1/2009
JP D1427812 7/2010
JP 2012006655 A 1/2012
JP 2016084147 A 5/2016
WO WO0132518 A1 5/2001
WO WO2005014438 A2 2/2005
WO WO2010090887 A1 8/2010

OTHER PUBLICATIONS

All Office Actions, U.S. Appl. No. 29/623,802.
White Flowers & Water Orchid Air Freshener (Reckitt Benckiser); Commercially available; download Jul. 2009.

* cited by examiner

PACKING SYSTEM AND METHOD OF PACKING

FIELD OF THE INVENTION

The present invention relates to packaging of articles for shipping and display, and more particularly relates to a packing system for a plurality of packages, a package for displaying an article, and a method of packing packages for shipping.

BACKGROUND OF THE INVENTION

Packages for displaying products are well known in the art. Generally, the package comprises a cardboard card attached to a plastic blister into which a product is placed. When the product has an irregular shape, it is difficult for efficient bulk packing of the packages for shipment.

In particular, stacking such irregularly shaped packages one after another in a standing position in a box generally results in unused airspace between adjacent packages. This leads to an increase in transportation costs as more boxes are required to pack a predetermined number of packages. Further the packages are typically not secured and may move freely within the carton and this might potentially damage the cardboard card as well as the product within the package. Filler materials may be used to protect the packages from movement but this increases the amount of packaging material used in making packages.

Published application GB 2 169 585A describe packaging of irregularly shaped articles which are packed in a staggered reverse orientation to reduce the total packaging volume occupied by such articles. U.S. Pat. No. 6,311,845 B1 describe packages which include a retainer for retaining upper packaged articles supported on lower packaged articles.

However, there remains a need to provide a packing system for a plurality of packages which minimizes the amount of packing space and a display package that is cost effective, and easy to manufacture.

SUMMARY OF THE INVENTION

The invention relates to a packing system for a plurality of articles comprising:

first and second packages;

wherein each of the first and second packages comprises:

a housing comprising a front wall and a rear wall;

an article disposed within the housing, at least a part of the article protruding from the front wall of the housing;

wherein the rear wall comprises a recessed portion, a shape of the recessed portion corresponding to a profile of the at least a part of the article protruding from the front wall, wherein the front wall of the second package is adjacent to the rear wall of the first package.

BRIEF DESCRIPTION OF THE DRAWINGS

FIGS. 3A, 3B, 3C, 3D and 3E are detailed views of FIG. 3;

DETAILED DESCRIPTION OF THE INVENTION

The invention relates to a package for displaying an article and a packing system for a plurality of packages for shipping to retail stores and for display to consumers in the retail stores. The package generally relates to packaging for an irregularly shaped object or an object with a contoured profile. The package described herein is designed to reduce the amount of packaging material, and packing space while enhancing the visibility of the product upon retail shelf placement. Specifically, the package comprises a housing modified to allow packages to be nested as shown such as for example in FIG. 3. In the following description, the article is an irregular shaped object such as a consumer product with a curved profile. The consumer product may include, but is not limited to, a volatile composition dispenser for dispensing a volatile composition in an interior space (such as a room).

Figure 1A:
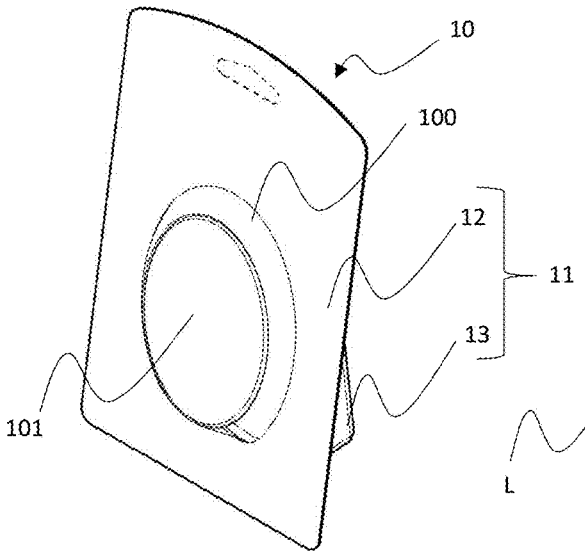
FIG. 1A is a front perspective view of a package for displaying an article according to the invention.
Figure 1B:
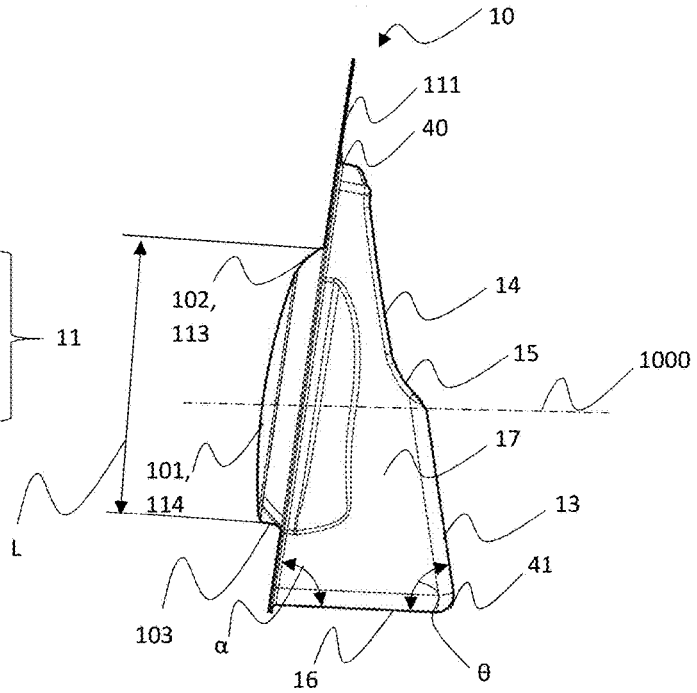
FIG. 1B is a side perspective view of the package of FIG. 1A.
Figure 2:
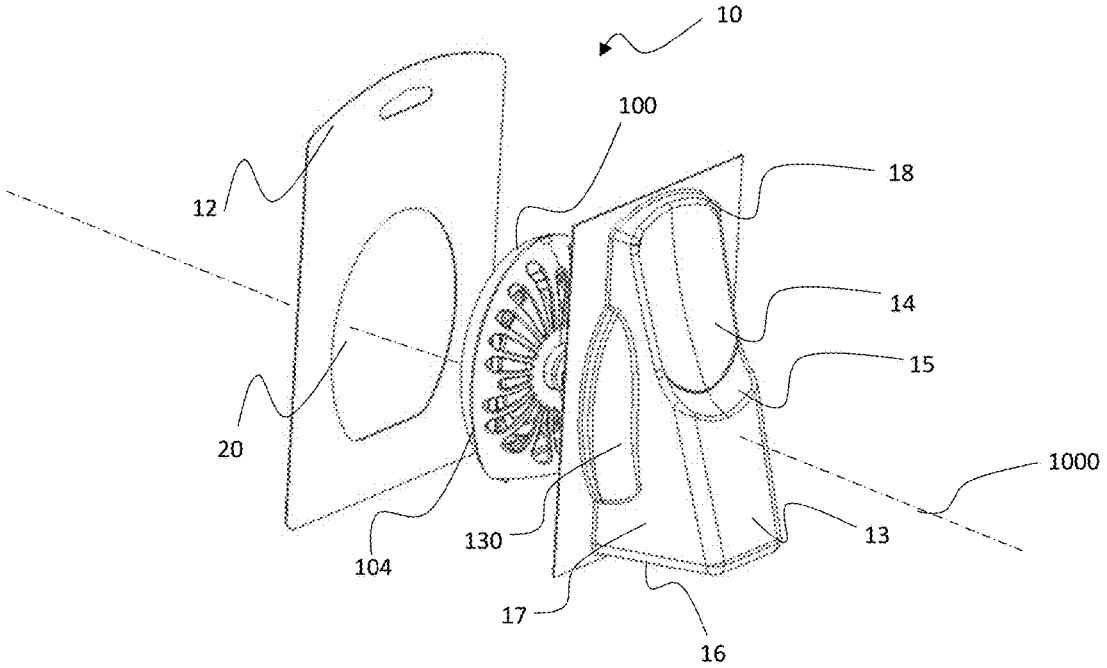
FIG. 2 is an exploded assembly view of the package of FIGS. 1A and 1B.

FIGS. 1A and 1B respectively show a front perspective view and a side view of a package 10 for displaying an article 100. FIG. 2 is an exploded assembly view which shows components of the package 10 spaced along a longitudinal axis 1000 of the package 10. Referring to FIG. 1A, the package 10 comprises a housing 11 in which the article 100 is disposed. The housing 11 comprises a front wall 12 and a rear wall 13 wherein at least a part 101 of the article 100 protrudes from the front wall 12 of the housing 11. The at least a part 101 may comprise a front portion 101 of the article 100.

Referring to FIG. 2, the front wall 12 may comprise an opening 20 through which the front portion 101 protrudes in a direction for display to an observer such as a consumer. The opening 20 may be configured to have a perimeter smaller than an outer periphery 104 of the article 100. Further as shown in FIG. 1, the front portion 101 of the article 100 may comprise one or more tapered sides, and accordingly, the opening 20 may be configured and sized to be large enough for the tapered sides of the article 100 to pass through, but the opening 20 is smaller than a rear portion 105 of the article 100 therefore stopping the whole article 100 from passing through. The rear wall 13 may comprise a rear protrusion 130 arranged for receiving the rear portion 105 of the article 100 so as to maintain the article in a fixed position within the housing 11.

Specifically, when the article 100 is assembled within the housing 11, the opening 20 functions to prevent the article 100 from moving outwards through the opening, and the rear protrusion 130 abuts the rear portion 105 of the article 100 to support the article within the housing 11. The rear protrusion 130 may be configured such that the rear portion 105 is not contacting the rear wall 14 (as shown in FIG. 1B). Consequently, due to the combination of the opening 20 and the rear protrusion 130, it is no longer necessary to have a transparent blister to keep the article 100 within the housing 11 thereby reducing the packaging material required to make a display package 10.

Referring to FIG. 1B, the front portion 101 may comprise a top surface 102 and a bottom surface 103 spaced apart from the top surface 102 to define a length L of the front portion. A recessed portion 14 is disposed in the rear wall 13 wherein the recessed portion 14 comprises a shape corresponding to a profile of the at least a part 101 of the article 100 such as the front portion 101. The recessed portion 14 may comprise at least one surface comprising the same profile as the top surface 102 of the article 100 in the package 10 so that a first package 10 and a second package 10' can be positioned adjacent to each other. A technical effect of the recessed portion 14 having the abovementioned shape is that it enables mating engagement between first and second packages 10, 10' such that the packages 10, 10' may be fit close together or one within another (i.e. nesting), details of which will be described with reference to FIG. 3.

Referring to FIG. 1B, the front portion 101 of the article 100 may comprise a top end 113 and a bottom end 114, wherein the shape of the recessed portion 14 corresponds to a vertically inverted profile of the front portion 101 of the article 100 such that at least one surface of the recessed portion 14 corresponds to the top end 113.

A technical effect is the packages can be stacked next to each other with one in a standing position and the other one in an upside-down position. An advantage is this minimizes any unused air space between two adjacent standing packages. As a result, this increases the number of packages that can be packed together in a box.

Additionally, minimizing the air space between two adjacent standing packages prevents movement of the packages in a box in a left-right direction during shipment. Consequently, there are reduced scuff marks or damages to the packages. Further, as the two packages are in an up-side down arrangement, this forms a generally rectangular and compact arrangement which allows the packages to be wrapped together with wrapping such as shrink wrap if required to further secure the packages.

Nesting of the packages minimizes shipping and storage space, thereby reducing shipping and storage costs. In particular, a number of packages which can be contained within a storage space (such as a carton box) may be increased, or a size of the storage space can be reduced.

Nesting also reduces relative forward and rearward movement of the first package relative to the second package when packed. Consequently, the packages are less susceptible to shipping damage generally caused by movement of packages within a carton box.

Figure 3:
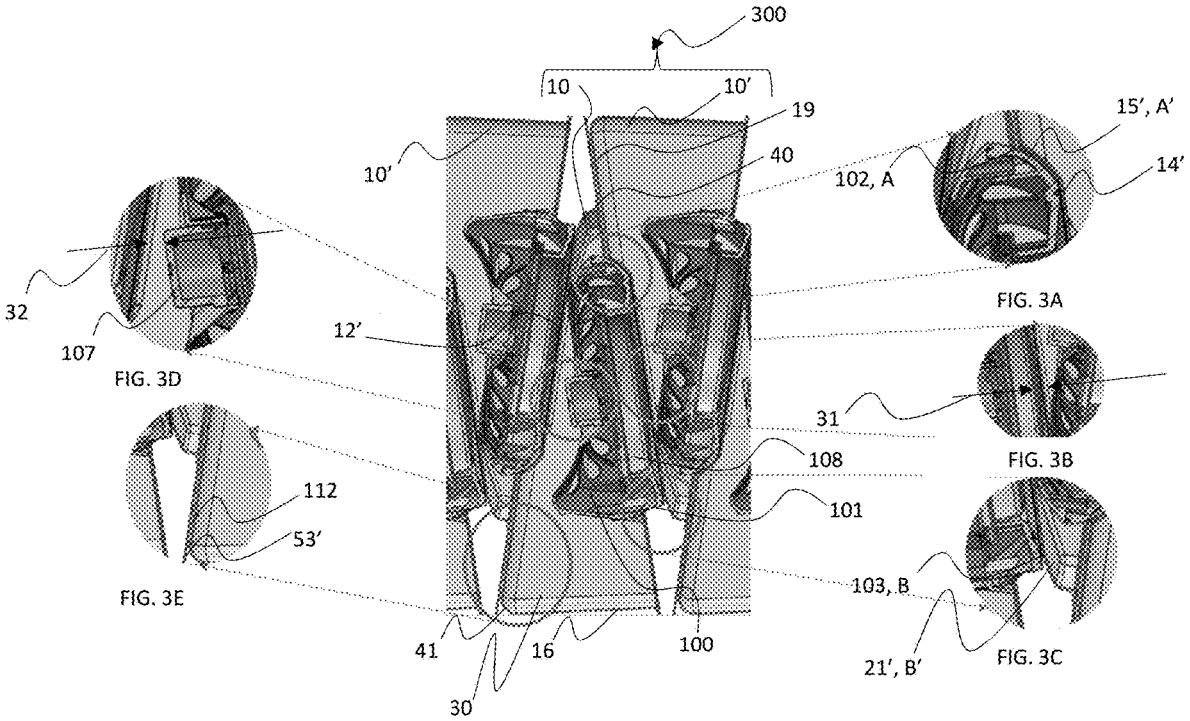
FIG. 3 is a side view of a plurality of assembled packages, such as shown in FIGS. 1A, 1B, and 2, being nested with one another.

Referring to FIG. 1B, the recessed portion 14 of the rear wall 12 may comprise at least one surface 15 having a shape corresponding to the top surface 102 of the front portion 101 such that the recessed portion 14 forms a vertically inverted shape of the profile of the front portion 101. In this way, the packages 10, 10' may be stacked next to each other with one in a standing position and the other one in an upside-down manner as shown in FIG. 3. An advantage of this arrangement is it eliminates any unused air space between two adjacent standing packages. As a result, this increases the number of packages that can be packed together in a box.

Additionally, minimizing the air space between two adjacent standing packages prevents movement of the packages in a box in a left-right direction during shipment. Consequently, there are reduced scuff marks or damages to the packages. Further, as the two packages are in an up-side down arrangement, this forms a generally rectangular and compact arrangement which allows the packages to be wrapped together with wrapping such as shrink wrap if required to further secure the packages.

The housing 11 may comprise a base 16 configured for supporting the package 10 in a standing position on a support surface such as on a shelf for product display in the stores or in a box for shipping. The housing 11 may further comprise first and second parallel side walls 17 spaced apart from each other and extending vertically from the base 16 so as to define a rear container 18 having a cavity for receiving the rear portion 105 of the article 100. An exterior of the cavity may be configured to be in the shape of the at least a part of the article. A technical effect is to provide additional protection of the article such as for example where the article is designed to be operated from the front and having a cavity will protect the article from unintended tampering prior to use.

The front wall 12 may be inclined at an acute angle ($\alpha$) relative to a support or a planar surface on which the package 10 is placed such that the package 10 is tilted in a direction facing a consumer during shelf placement. The acute angle ($\alpha$) may be in a range greater than 45° to less than or equal to 90°. Preferably for optimal viewing display to consumers on shelf and stability, the acute angle ($\alpha$) may be in a range greater than 70° to less than or equal to 90°.

Referring to FIG. 1B, the rear wall 13 may be inclined at an acute angle ($\theta$) relative to a support or a planar surface on which the package 10 is placed such that the front wall 12 and the rear wall 13 may be joined at a top 19 of the package 10 and the cross section of the package 10 forms a generally triangular shape. This results in the package 10 having a substantially wedge-shape which to enables stable placement of the package on a support surface such as a shelf.

Further, the package may be placed in a substantially upright position on a product display or on a store shelf without requiring an external structure support. The acute angle ($\theta$) may be in a range greater than 45° and less than or equal to 90°. Preferably, the acute angle (θ) may be in a range greater than 70° and less than or equal to 90°.

FIG. 3 is a side view of an assembled packing system 300 comprising first and second packages 10, 10', such as shown in FIG. 1, in a nesting arrangement wherein the front wall 12' of the second package 10' is in contact with the rear wall 13 of the first package 10. However, it will be appreciated by the person skilled in the art that the front wall 12' of the second package 10' may also be adjacent to the rear wall 13 of the first package 10 instead of being in contact to enable nesting of the first and second packages 10, 10'. The front portion 101 of the article 101 may be matingly engaged with the concave profile of the recessed portion 14' of the second package 10'. A mating engagement better secures the first and adjacent packages to achieve an interlocking effect without additional securing means such as shrink wrap or tape to bind the packages together.

The rear wall 13 may further comprise a proximal end 40 adjacent to a top 111 of the housing 11 and a distal end 41 adjacent to the base 16 wherein the rear wall 13 comprises a continuous surface between the proximal end 40 and the distal end 41. The rear wall 13 may further comprise a protruded portion 30 joined to the recessed portion 14.

FIGS. 3A to 3E are detailed views of FIG. 3. Referring to FIG. 3A, the at least one surface 15' of the recessed portion 14' of the second package 10' comprises the same profile A, A' as the top surface 102 of the article 100 in the first package 10 so as to form a surface contact at A-A'. The at least one surface 15' may comprise a concave profile configured to receive a convex profile of the top surface 102 of the front portion 101 of the article 100. Referring to FIG. 3C, the recessed portion 14' may further comprise a second surface 21' spaced apart from the at least one surface 15' wherein the second surface 21' comprises the same profile B, B' as the bottom surface 103 of the front portion of the article 100 so that the surfaces A-A' and B-B' may be in contact upon assembly. An effect of the surface contact between surfaces A-A' and B-B' is that when the packages 10, 10' are horizontally stacked within an enclosure such as a case, adjacent packages may be interlocked thereby minimizing movement during transportation or handling of the case.

Referring to FIG. 3B, the packing system 300 may comprise a package spacing 31 between the rear wall 13' of the second package 10' and the front portion 101 of the article 100 of the first package 10. When the front portion 101 comprises a fragile surface, an advantage of the package spacing 31 is to protect the fragile surface from aesthetic damages such as dents and scratches.

Referring to FIG. 3D, a volume and shape of the cavity of the rear container 18 may be configured for receiving the article 100 such that when the article 100 is retained in the opening 20, there is a gap 32 between a protrusion 107 extending from the rear portion 105 of the article 100. Specifically, the rear wall 13 being inclined at an acute angle (θ) relative to the base 16 such as to form the gap 32. For example, the article 100 may be an air freshener device 100 and the protrusion 107 may be a push button 107 disposed within a housing 11. The push button 107 may be configured for activating an air freshener cartridge or a thermoform refill container 108 within the housing 11 such that air freshening composition may be released from the cartridge 108 into the environment when the push button 107 is pressed into the housing 11. The outer surface 180 of the thermoform refill container 108 may form the front portion 101 of the article 100 protruding from the front wall 12.

A technical effect of having the gap 32 enables a safety distance to be maintained between the push button 107 and the rear wall 13 which prevents the push button 107 from being inadvertently pushed into the housing 11 and pre-activated during shipping.

Referring to FIG. 3E, the protruded portion 30 of a first package 10 may comprise an oblique surface 112 configured for supporting a top side 53' of the front wall 12' of a second package 10'.

Nesting of the packages as described in the above minimizes shipping and storage space, thereby reducing shipping and storage costs. In particular, a number of packages which can be contained within a storage space (such as a carton box) may be increased, or a size of the storage space can be reduced. Specifically, an advantage of a packing system according to the present invention is a number of packages that may be shipped in a pallet may be increased by 15-20% relative to conventional packing systems.

Nesting also reduces relative forward and rear movement of the first package relative to the second package when packed. Consequently, the packages are less susceptible to shipping damage generally caused by movement of packages within a container such as a box.

Figure 4A:
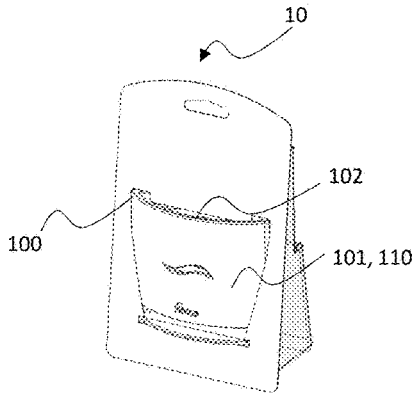
FIG. 4A is a front perspective view of a package for an elliptical shaped article according to the invention.
Figure 4B:
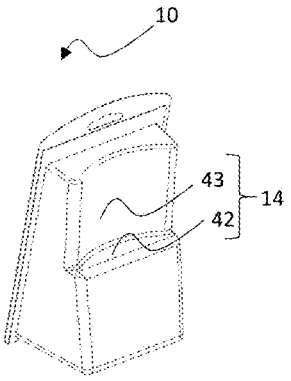
FIG. 4B is a side perspective view of the package of FIG. 4A.

FIG. 4A is a front perspective view of a package 10 for an article 100 according to the invention. FIG. 4B is a rear perspective view of the package 10. The package 10 of FIG. 5A, 5B differs from the package 10 of FIG. 1 in that the article 100 of FIG. 4A, 4B has a different shape and size from the article 100 of FIG. 1. Consequently, the front portion 101 comprises a different design and has a front face 110 having a substantially convex shape and the recessed portion 14 corresponds to a profile of the front portion 101.

Figure 5:
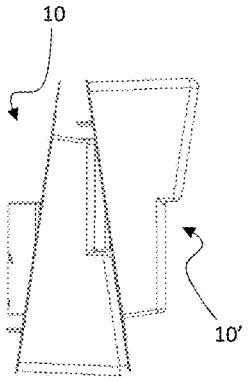
FIG. 5 is a side view of two assembled packages, such as shown in FIGS. 4A and 4B, being nested with one another.

Referring to FIG. 4B, the recessed portion 14 may comprise first and second adjoining surfaces 42, 43 in a vertically inverted shape of the profile of the front portion 101. Specifically, the first surface 42 of the recessed portion 14 may be a planar surface sized and shaped to receive a top surface 102 of the front portion 101. The second surface 43 may be a concave surface shaped to receive the front face 110 of the front portion 101 of the article 100. FIG. 5 is a side perspective assembly view of two packages 10, 10' such as in FIGS. 4A and 4B, being nested with one another.

Figure 6A:
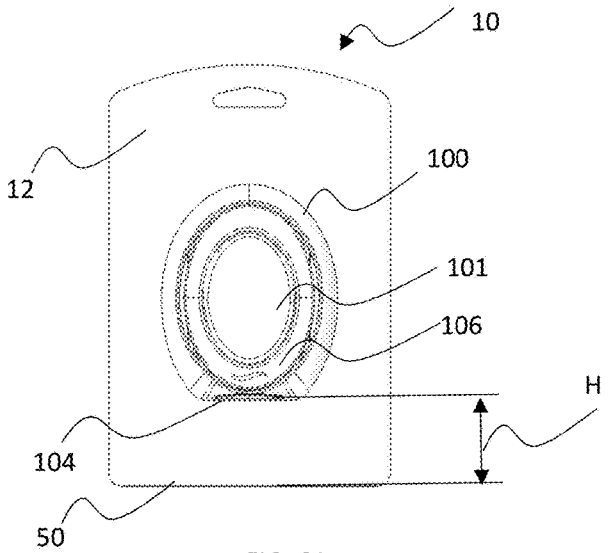
FIG. 6A is a front view of a package according to the invention, having an article being positioned at a height H relative to a bottom end of the front wall.
Figure 6B:
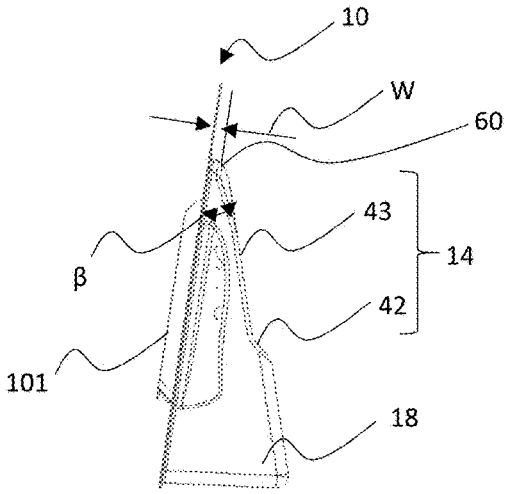
FIG. 6B is a side view of the package of FIG. 6A.

FIGS. 6A and 6B are front and side views of a package 10 substantially similar in structure to the package of FIG. 1 but with a different design of the front portion 101. Due to the different design of the front portion 101, i.e. the front portion 101 having a curved inner surface 106, the rear container 18 may comprise a top 60 having a thinner width W relative to a width of the rear container 18 of FIG. 1B so as to receive the curved inner surface 106 of the front portion 101. The recessed portion 14 may comprise first and second adjoining surfaces 42, 43 in a vertically inverted shape of the profile of the front portion 101. The first surface 42 may comprise a substantially concave profile and the second surface 43 may comprise a substantially planar profile. The second surface 43 may be a sloping surface inclined towards the front wall 12 to define an acute angle (β) between the front and rear walls 12, 13. Further, the article 100 may be positioned within the front wall 12 such that a bottom surface 103 of the article 100 is at a height H with respect to a bottom end 50 of the front wall 12.

Figure 7A:
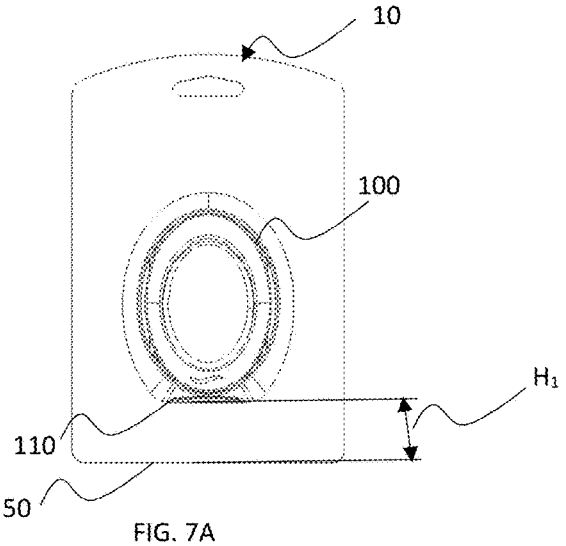
FIG. 7A is a front view of a package according to the invention, having an article being positioned at a height $H_1$ relative to a bottom end of the front wall.
Figure 7B:
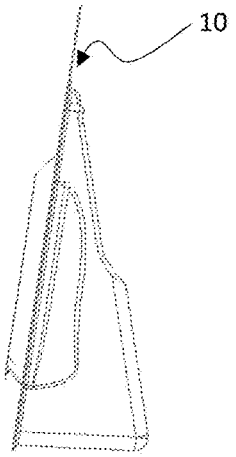
FIG. 7B is a side view of the package of FIG. 7A.

Further, referring to FIGS. 7A and 7B, the article 100 may be positioned within the front wall 12 at a different height $H_1$ wherein $H_1$ is less than H. Specifically, the size of the recessed portion 18 may decrease as the height H reduces. Still further, referring to FIGS. 8A and 8B, the article 100 may be positioned within the front wall 12 wherein the bottom surface 103 of the article 100 is aligned with the bottom end 50 of the front wall 12.

Figure 8A:
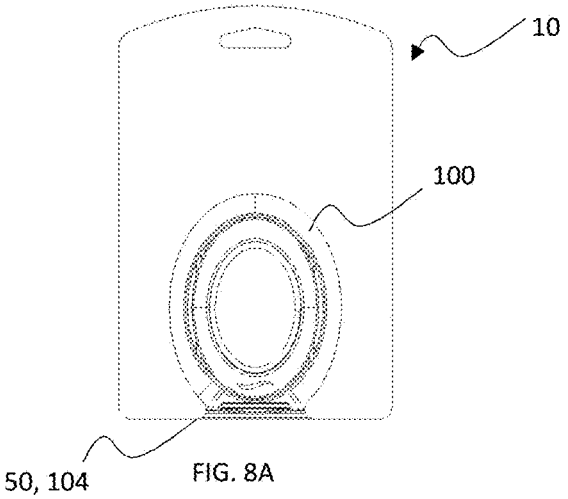
FIG. 8A is a front view of a package according to the invention, having an article being positioned such that its base is substantially aligned with the base of the package.
Figure 8B:
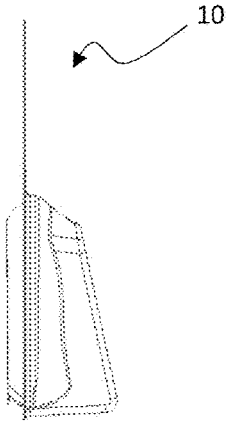
FIG. 8B is a side view of the package of FIG. 8A.
Figure 9:
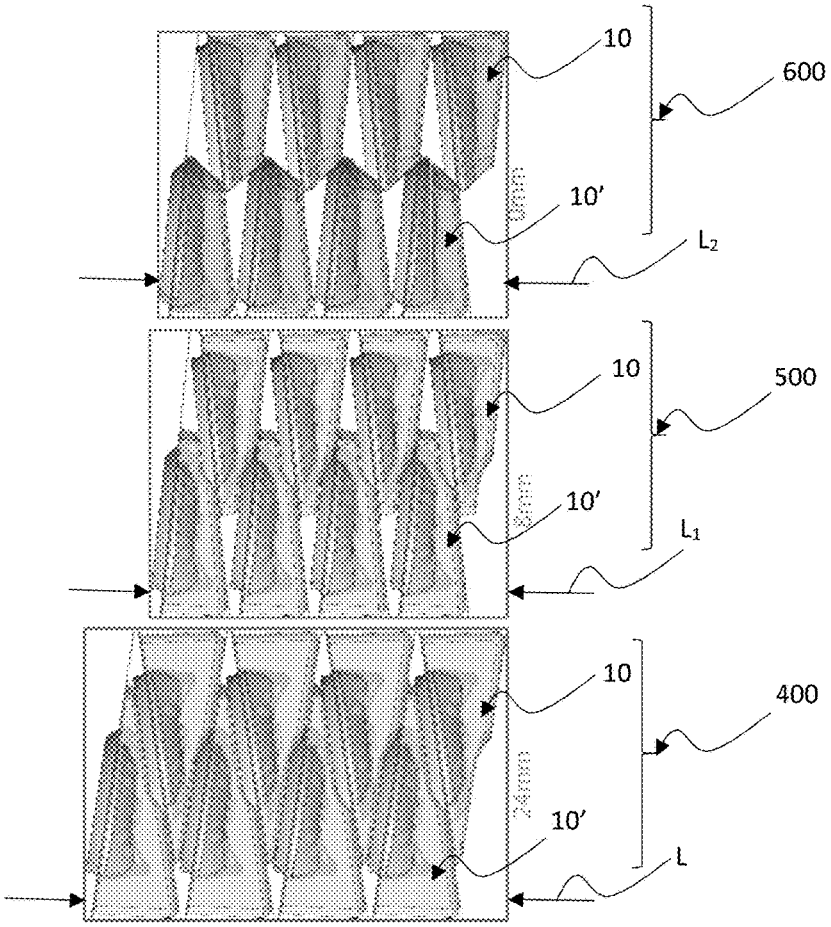
FIG. 9 is a side view of a plurality of assembled packages according to the invention, such as shown in FIGS. 6A, 7A and 8A, being nested with one another.

FIG. 9 is a side perspective view of a comparison between an assembled packing system 400 comprising a plurality of the packages 10, 10' such as shown in FIGS. 6A, and 6B, an assembled packing system 500 comprising a plurality of the packages 10, 10' such as shown in FIGS. 7A, and 7B, and an assembled packing system 600 comprising a plurality of the packages 10, 10' such as shown in FIGS. 8A and 8B, being nested with one another respectively.

The packing system 400 comprises an overall length (L). However, referring to the packaging systems 500, and 600, for the same overall height of the front wall 12, if the height H is reduced or the bottom surface 103 of the article 100 is aligned with the bottom end 50 of the front wall 12 of the package 10, the overall length ($L_1$, $L_2$) of the packed packages will be reduced as shown in FIG. 9 relative to the overall length L of the packing system 400. This is because the rear container 18 becomes shorter and the angle ($\alpha$) between the front wall 12 and the base 16 increases correspondingly. Consequently, there are savings in the amount of packaging material used with the additional benefit of customizing an amount of packing space based on different packing requirements.

Another advantage of positioning the article 100 at different heights $H_1$, $H_2$ relative to the bottom end 50 of the front wall 12 provides a clearance between the package 10 and the display shelf so that the article 100 is visible when placed on the shelf. Further, the clearance from shelf to packed device) is relevant for cases where the device needs to be uplifted in the pack, so it is visible in situations where items are packed in a shelf ready tray (with a front wall, will occur when soldier packed) or in shelves which have pricing elements in front of them. An example of a pricing element may be a price tag bar configured for placement in front of products for sale on the shelf, wherein the price tag bar may comprise a height of about 30 mm. In these cases, a higher height H will ensure the product is fully visible. In situations where there is no such barrier, the height H can be minimized. The opening 20 in the front wall 12 may be configured accordingly to enable the height H of the article 100 relative to the bottom end 50 of the front wall 12 to be varied as described in the above.

Figure 10:
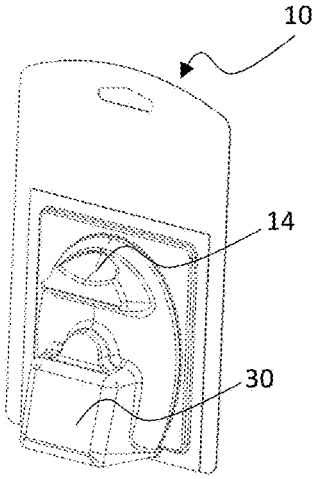
FIG. 10 is a rear perspective view of a package according to the invention.
Figure 11:
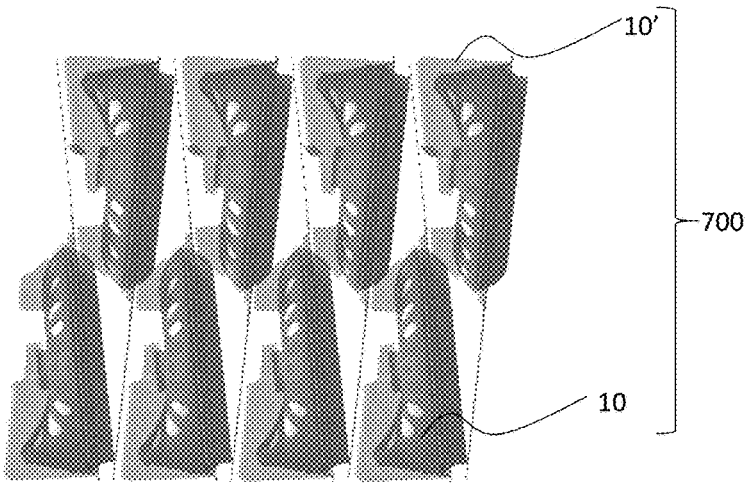
FIG. 11 is a side view of a plurality of assembled packages, such as shown in FIG. 10, being nested with one another.

FIG. 10 is a rear perspective view of a package 10 according to the invention and FIG. 11 is a side perspective view of an assembled packing system 700 comprising a plurality of packages 10, 10' of FIG. 10 being nested with one another.

The package 10 of FIG. 10 has substantially the same elements as the package 10 of FIG. 1 but differs from the package 10 of FIG. 1 in that the recessed portion 14 is segmented from the protruded portion 30 and the rear wall 13 forms a discontinuous surface. An advantage is minimizing a contact area between packages 10, 10' so as to reduce risks of scuffing and surface damage during shipping and/or handling.

Figure 12:
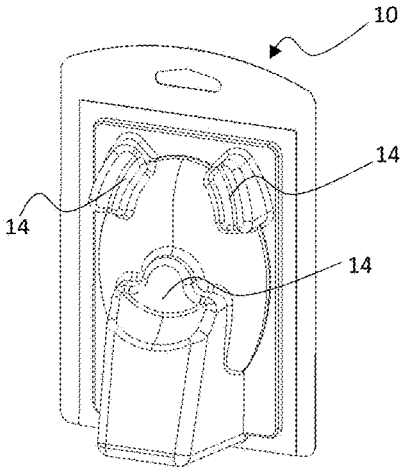
FIG. 12 is a rear perspective view of a package according to the invention.

Referring to FIG. 12, the rear wall 13 may comprises a plurality of recessed portions 14 for receiving sides of the front portion 101 of the article 100. Specifically, there may be three recessed portions 14 wherein two of the three recessed portions 14 are segmented from the protruded portion 30 and configured for receiving sides of the front portion 101' proximal to a bottom surface 103' of an article 100' of a second package 10'. The other one of the three recessed portions 14 is joined to the protruded portion 30 and configured for receiving a top surface 102' of the front portion 101' of an article 100' of a second package 10'. The recessed portions 14 result in increased retaining of the articles in the box during shipping due to an increase in the contact area between the front portion 101 and the recessed portion 14. Therefore, left right movement of the packages during shipping may be minimized thereby preventing damage to the packages.

Figure 13:
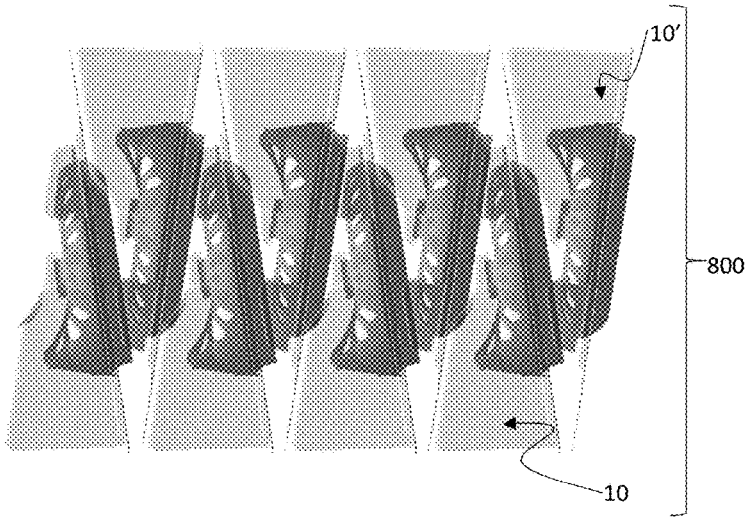
FIG. 13 is a side view of a plurality of assembled packages, such as shown in FIG. 11, being nested with one another.

FIG. 13 is a side perspective view of an assembled packing system 800 comprising a plurality of packages 10, 10' of FIG. 12 being nested with one another.

A method of packing is described herein. To pack the packages 10, 10' in a packing system 300, 400, 500, 600, 700, 800 such as shown in FIGS. 3, 9, 11 and 13 respectively, a first array of first packages 10 may be sequentially placed in a carton box (not shown) with bases 16 of the first packages 10 on a bottom surface of the carton box and top ends 51 of the front walls 12 extending upwardly away from the bottom surface. Then, a second array of second packages 10' may be alternately inserted between the first packages 10 of the first array such that a recessed portion 14' of each of the second packages 10' engages a front portion 101 of an article 100 in each of the packages 10 and the front wall 12' of the second package 10' is in contact with the rear wall 13 of another first package 10.

In this way, adjacent first and second packages 10, 10' are interlocked to prevent free movement of the packages 10, 10' within the carton box. The effect of interlocking is enabled by the recessed portion 14' being proximate to the front portion 101 within each package 10, 10' and this also allows the stack of packages 10, 10' to form a generally parallelogram shaped compact stack during packing and therefore reducing a packing volume of the packages 10, 10'. Further The first and second packages can be nested and shrink wrapped or packed in carton boxes for shipping and/or storage while maintain a same orientation of the packages for placement on store shelves for display and sale to consumers.

Figure 14:
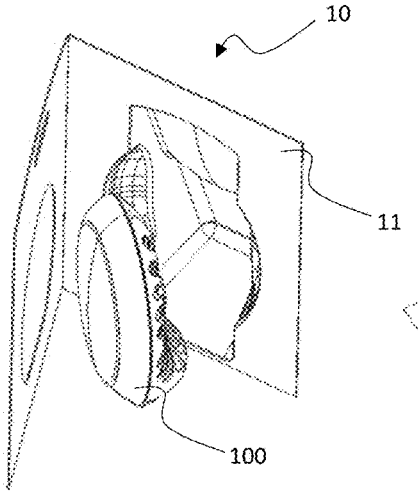
FIG. 14 is an exploded assembly view of a package according to the invention.
Figure 15:
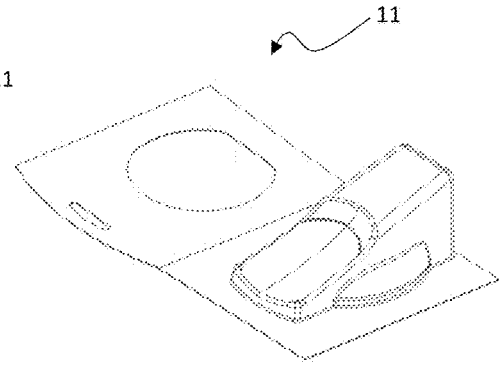
FIG. 15 is a rear perspective view of a housing according to the invention.

As shown in FIG. 2, the front wall 12 and the rear wall 13 may be two separate components which may be attached together by an attachment means such as adhesives, so as to form the housing 11. However, as shown in FIG. 14, the front wall 12 may be integral with the rear wall 13 to form a single integral housing 11 for housing the article 100. FIG. 15 is a rear perspective view of the single integral housing 11.

Figure 16:
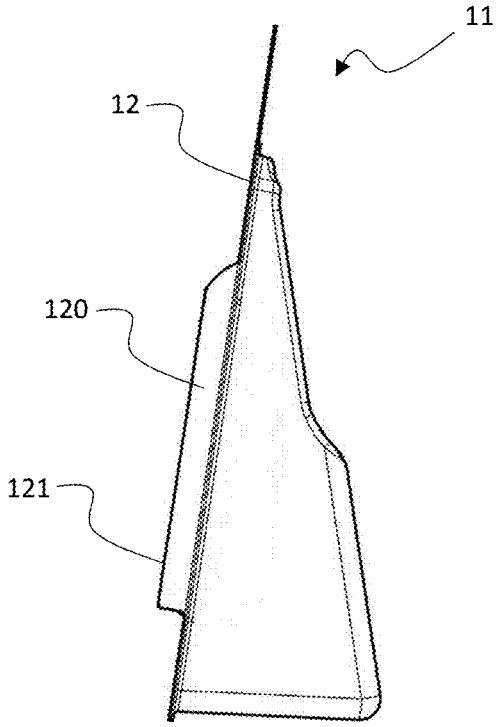
FIG. 16 is a side view of a housing according to the invention.

Alternatively, referring to FIG. 16 which is a side perspective view of the housing 11, the front wall 12 may comprises a cavity 120 configured to receive the at least a part 101 of the article 100 protruding from the front wall 12 of the housing 11, wherein an exterior 121 of the cavity 120 is in the shape of the at least a part 100 of the article 100. The cavity 120 and the front wall 12 may be separate components which may be attached together by an attachment means or the cavity 120 may be integral with the front wall 12.

Different variations of a package 10 according to the invention are shown in Table 1 below based on the desired packaging material and the respective manufacturing methods.

TABLE 1

Table of Materials and Manufacturing Methods for Making the Package Components

| Package Design | Package Components | Material | Manufacturing Method |
|---|---|---|---|
| Option A 2-piece Package | (i) Front Wall with Opening | (i) Cardboard | Die-Cut |
| | (ii) Front Wall with Cavity | (ii) Thermoplastic polymers (PET, PE, PP) | Thermoform, Injection Molding |
| | Rear Container | Thermoplastic polymers (PET, PE, PP) | Thermoform, Injection Molding |
| Option B-Single Piece integral Package (Front wall integral with Rear Wall/Container) | (a) (i) Fiber molding plus cardboard | (a) (i) Paper Fiber | (a) (i) Molded fibers (such as used in egg cartons) and die-cut cardboard (Paper fiber molded and folded and/or additional card with cut outs with the article disposed in between) |
| | (ii) Thermoform with plastic card | (a) (ii) PET | (a)(ii) Thermoformed blister with plastic card that is die cut |
| | (b) Foldable blister (Clam Shell) | PET | Thermoform (thermoformed clam shell and folded with device in between, connection either sealing or clipped in) |
| | (c) Rigid package with an opening for article to protrude from | PP, PE | Injection molding (Entire structure is molded as single piece, with an opening for the device to enter & clipped on later) |

An advantage of making a package 10 based on Option A(i) is that such a package will be the most efficient one when it comes to manufacturability and material cost and strikes a good balance in terms of decoration. For example, the front wall 12 may comprise graphics and print for providing indicia such as product description, advertisement, and instructions for using the product. Alternatively, a package based on Option A(ii) may enable additional protection of the article 100 such as for example where the article is designed to be operated from the front and having a cavity will protect the article from unintended tampering prior to use.

Alternatively, a package 10 may be manufactured based on Option B subject to different design, manufacturing and cost requirements such as set out below, specifically:

(a) Based on Option B(a)(i), molded fibers may be used where the package is designed for a premium product (to provide a consumer perception of quality), such that the rear container may be opaque.

(b) Alternatively, a package based on Option B(a)(ii) may enable consumers to have a visual of the article through displaying the article through a plastic front wall. However, a thickness of the front wall may be increased thereby increasing material costs.

(c) Based on Option B(b), clam shells may be cost effective depending on the size, but the visual impact of the product package on shelf is reduced because the package will be smaller on shelf and there is less space for artwork to be printed on the package and an additional insert may be required for high quality decoration or artwork.

(d) Referring to Option B(c), injection molding enables the packages to be manufactured in high volumes in a fast amount of time but it is an expensive process relative to Option A.

An example is shown below:

A. A packing system for a plurality of articles comprising: first and second packages;

wherein each of the first and second packages comprises: a housing comprising a front wall and a rear wall;

an article disposed within the housing, at least a part of the article protruding from the front wall of the housing;

wherein the rear wall comprises a recessed portion, a shape of the recessed portion corresponding to a profile of the at least a part of the article protruding from the front wall, wherein the front wall of the second package is adjacent to a rear wall of the first package.

B. The packing system according to A, wherein the at least a part of the article comprises a top end and a bottom end, wherein the shape of the recessed portion corresponds to a vertically inverted profile of the at least a part of the article such that at least one surface of the recessed portion corresponds to the top end.

C. The packing system according to A, wherein the front wall comprises an opening through which the at least a part of the article protrudes from the front wall, and the rear wall comprises a rear protrusion for receiving a back portion of the article for maintaining the article in a fixed position within the housing.

D. The packing system according to A, wherein the front wall comprises a cavity configured to receive the at least a part of the article protruding from the front wall of the housing, wherein an exterior of the cavity is in the shape of the at least a part of the article.

E. The packing system according to A, wherein the recessed portion comprises at least one concave profile.

F. The packing system according to A, wherein the recessed portion comprises first and second adjoining surfaces, one of the first and second adjoining surfaces comprising a concave profile while the other one of the first and second adjoining surfaces comprising a planar profile, wherein the concave profile corresponds to a corresponding convex surface of the at least a part of the article.

G. The packing system according to E or F, wherein the at least a portion of the protruding portion of the article is matingly engaged with the concave profile of the recessed portion of the rear wall.

H. The packing system according to A, wherein the rear wall comprises a plurality of recessed portions arranged for receiving a periphery of the at least a part of the article.

I. The packing system according to A, wherein a base of the article is at a height (H) with respect to a bottom end of the front wall.

J. A method of packing packages for shipping, the method comprising:

a) providing a plurality of first packages and a plurality of second packages, wherein each of the plurality of first and second packages comprises:
   a housing comprising a front wall and a rear wall;
   an article disposed within the housing, at least a part of the article protruding from the front wall of the housing;
   wherein the rear wall comprises a recessed portion, a shape of the recessed portion corresponding to a profile of the at least a part of the article protruding from the front wall;

b) arranging each of the plurality of second packages between adjacent first packages, wherein the front wall of a second package is in contact with the rear wall of a first package.

K. The method according to J, further comprising arranging the plurality of first packages in a sequential order on a bottom surface of a carton box prior to step (b), wherein the recessed portion is disposed on an upper part of the rear wall.

L. A housing for displaying an article comprising:

a rear container comprising a rear wall, a base and opposing side walls, wherein the rear wall and the opposing side walls extend from the base defining a cavity for receiving the article;

a front wall for attaching to a front side of the rear container opposite to the rear wall;

wherein the front wall comprises an opening sized to allow at least a part of the article to protrude from the front wall;

wherein the rear wall comprises a recessed portion, a shape of the recessed portion corresponding to a profile of the at least a part of the article.

M. The housing according to L, wherein the at least a part of the article comprises a top end and a bottom end, wherein the shape of the recessed portion corresponds to a vertically inverted profile of the at least a part of the article such that at least one surface of the recessed portion corresponds to the top end.

N. The housing according to L, wherein the rear wall comprises a rear protrusion for receiving a back portion of the article for maintaining the article in a fixed position within the housing.

O. The housing according to L, wherein the recessed portion comprises at least one concave profile.

P. The housing according to L, wherein the recessed portion comprises first and second adjoining surfaces, one of the first and second adjoining surfaces comprising a concave profile while the other one of the first and second adjoining surfaces comprising a planar profile, wherein the concave profile corresponds to a corresponding convex surface of the at least a part of the article.

Q. The housing according to L, wherein the rear wall comprises a plurality of recessed portions arranged for receiving a periphery of the at least a part of the article.

R. The housing according to L, wherein the housing comprises a base, wherein the front wall is tilted at an acute angle (θ) relative to the base of the housing towards the rear wall to define a triangular shaped cross section.

S. The housing according to L, wherein a base of the article is at a height (H) with respect to a bottom end of the front wall.

T. A product package comprising:

an article; and a housing according to L for displaying the article.

U. A product package according to T, wherein the article is an air freshener comprising a rear portion, wherein the rear portion comprises an irregular shape.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packing system for a plurality of articles comprising:

first and second packages;

wherein each of the first and second packages comprises:

a housing comprising a front wall and a rear wall;

an article disposed within the housing, at least a part of the article protruding from the front wall of the housing;

wherein the rear wall comprises a recessed portion, a shape of the recessed portion corresponding to a profile of the at least a part of the article protruding from the front wall, wherein the front wall of the second package is adjacent to a rear wall of the first package, wherein the front wall comprises an opening through which the at least a part of the article protrudes from the front wall, and the rear wall comprises a rear protrusion for receiving a back portion of the article for maintaining the article in a fixed position within the housing, wherein the front wall is a cardboard card, and wherein the rear wall is a thermoformed blister, wherein one of the first package and second package is disposed in a standing position and the other one of the first or second packages is disposed in an upside-down position relative to the standing position, wherein the recessed portion comprises at least one concave profile, and wherein the at least a portion of the protruding portion of the article is matingly engaged with the concave profile of the recessed portion of the rear wall.

2. The packing system according to claim 1, wherein the at least a part of the article comprises a top end and a bottom end, wherein the shape of the recessed portion corresponds to a vertically inverted profile of the at least a part of the article such that at least one surface of the recessed portion corresponds to the top end.

3. The packing system according to claim 1, wherein the recessed portion comprises first and second adjoining surfaces, one of the first and second adjoining surfaces comprising a concave profile while the other one of the first and second adjoining surfaces comprising a planar profile, wherein the concave profile corresponds to a corresponding convex surface of the at least a part of the article.

4. The packing system according to claim 1, wherein the rear wall comprises a plurality of recessed portions arranged for receiving a periphery of the at least a part of the article.

5. The packing system according to claim 1, wherein a base of the article is at a height (H) with respect to a bottom end of the front wall.

* * * * *